US005736490A

United States Patent [19]

Bouffet et al.

[11] Patent Number: 5,736,490

[45] Date of Patent: Apr. 7, 1998

[54] AUTOMOTIVE WHITE-OIL BASED LUBRICANT COMPOSITION

[75] Inventors: Alain Gabriel Bouffet; Marcel Alphonse Ostyn, both of Bois Guillaume, France

[73] Assignee: Exxon Research and Engineering Company, Florham Park, N.J.

[21] Appl. No.: 604,931

[22] PCT Filed: Aug. 26, 1994

[86] PCT No.: PCT/EP94/02829

§ 371 Date: Apr. 24, 1996

§ 102(e) Date: Apr. 24, 1996

[87] PCT Pub. No.: WO95/06701

PCT Pub. Date: Mar. 9, 1995

[30] Foreign Application Priority Data

Sep. 3, 1993 [FR] France ..... 93 10536

[51] Int. Cl.[6] ..... C10M 169/04

[52] U.S. Cl. ..... 508/272; 508/333; 508/353; 508/433; 508/443; 508/584; 508/572; 508/591

[58] Field of Search ..... 508/591, 272, 508/333, 353, 433, 443, 584, 572

[56] References Cited

U.S. PATENT DOCUMENTS

| | | | |
|---|---|---|---|
| 2,335,331 | 11/1943 | Wright et al. | 508/591 |
| 4,062,785 | 12/1977 | Nibert | 508/272 |
| 4,098,703 | 7/1978 | Crossfield et al. | 252/8.6 |
| 5,321,172 | 6/1994 | Alexander et al. | 585/2 |

*Primary Examiner*—Jacqueline V. Howard
*Attorney, Agent, or Firm*—Susan Fletcher Watts; Joseph J. Allocca

[57] ABSTRACT

An automotive lubricant composition comprises a white oil basestock and at least one polyisoalkylene compound. The polyisoalkylene, e.g. polyisobutylene, acts as an antioxidant. The lubricant is used, for example, as an engine oil, gear oil or automatic transmission fluid. The lubricant may contain one or more additional antioxidants and other lubricant additives.

11 Claims, No Drawings

AUTOMOTIVE WHITE-OIL BASED LUBRICANT COMPOSITION

The present invention relates to automotive lubricant compositions based on white oil, and especially to automotive lubricants such as engine oils, gear oils and automatic transmission fluids.

Traditionally automotive lubricants have been based on conventional mineral oils. Whilst these have proved adequate in the past, mineral off basestocks cannot always meet the increasing demands for superior lubricant properties, especially operational lifetime. These improved properties can be achieved to some extent by the use of additives, but research has also been conducted into modifying or changing the basestocks. In recent years lubricant manufacturers have produced automotive lubricants based on synthetic basestocks, for example polyalphaolefins and esters. Whilst these provide improved performance, they have the disadvantage that they are expensive.

There is therefore a need for an automotive lubricant with an alternative, less expensive basestock which provides improved properties.

International application WO 93/16151 describes an automotive lubricant composition comprising a basestock of which at least 30 wt. % is a white oil basestock and at least one antioxidant additive. Other, conventional, lubricant additives may also be included. This white oil-based lubricant has the advantage that it exhibits better oxidation stability than comparative mineral-based lubricants, but is less expensive than comparative synthetic-based lubricants.

The present invention relates to a further improvement in the oxidation stability of white oil-based automotive lubricants.

In one aspect, the present invention provides an automotive lubricant composition comprising a white oil-containing basestock and at least one polyisoalkylene compound.

In another aspect, the present invention provides a method of providing or enhancing protection against oxidation of a lubricating oil (e.g., a white oil-containing lubricating oil) by adding to, or incorporating in, the lubricating oil, at least one polyisoalkylene compound.

In another aspect, the invention provides a method of operating automotive equipment selected from one or more items chosen from an internal combustion engine, a gearbox, an automatic transmission, the method comprising lubricating the said equipment with an automotive lubricating composition comprising a white-oil containing basestock and at least one polyisoalkylene compound.

Polyisoalkylenes such as polyisobutylene are known for use as thickeners to increase the viscosity of lubricants based on conventionally refined mineral oils. We have found, surprisingly, that when polyisoalkylene is added to a white oil-based lubricant it has the effect of improving its oxidation stability so that the resulting polyisoalkylene-containing white oil-based lubricant can be employed as an automotive lubricant. Polyisoalkylenes have not previously been proposed or used as anti-oxidants. Thus the resulting automotive lubricant of the invention has the benefit of increased efficacious operation times, i.e. it can be used to lubricate an automotive mechanical device, for example an internal combustion engine or gear box or automotive transmission for an extended period before it requires replacing. In some applications the lubricant can be used as a fill-for-life lubricant, i.e. the operational life-time of the lubricant matches or exceeds that of the mechanical part it is lubricating.

The white oil used as the base oil for the lubricant of the present invention may be a white oil obtained by solvent extraction of a lubricant basestock feed and hydrogenation of the resulting raffinate in one or more hydrogenation stages to produce a white oil lubricant basestock which is virtually free of sulphur and nitrogen. White oils are defined in the "Food and Drug Adminstration Code of Federal Regulation", 1991. Either medicinal white oils according to specification FDA 21 CFR 178-3620 (a) or technical white oils according to specification FDA CFR 178-3620 (b) may be employed in the present invention.

Preferably the white oil is highly naphthenic. It has been found that white oils with a relatively high naphthenic content exhibit improved properties compared with more paraffinic white oils. Preferably the white oil, used in the present invention has a naphthenic content of at least 25 wt. %, where 'naphthenic content' is defined as the amount of naphthenic carbon as a percentage of the total carbon content of the white oil, according to standard test ASTM D 2140. More preferably the naphthenic content of the white oil is from 30 to 50 wt. %, more preferably 30 to 40 wt. %. A highly naphthenic white oil is obtained by using mild hydrogenation conditions, so that the cyclic molecules contained in the oil are not substantially broken. Typical mild hydrogenation conditions are a temperature in the range of from 150° to 250° C., and a pressure in the range of from 1000 to 20,000 kPa, e.g., about 4,000 kPa. A method of making a suitable white oil is described in patent GB-A-1597165, the disclosures of which form part of the disclosure in the present patent application.

In a preferred method of making the white oil basestock, a lubricating oil basestock is subjected to solvent extraction with a solvent having an affinity for aromatic hydrocarbons. Suitable solvents for this purpose include N-methylpyrrolidone, phenol, furfural, and sulfur dioxide (inter alia). The aromatics-depleted raffinate is then subjected to hydrogenation treatment in the presence of a suitable hydrogenation-promoting catalyst such as Ni-W on an alumina-containing support. The resulting hydrogenated raffinate is stabilised within the desired lubricating oil boiling range, and is then a white oil suitable for use in the present invention. There is not usually any requirement to dewax the white oil (or its precursors during manufacture). The solvent extraction may be so performed that no more than 7% aromatics remains in the raffinate.

The white oil product, as described, may be subjected to a second hydrogenation stage under the same or similar conditions to those used in the first stage (e.g., 150° to 250° C. temperature range, 1000 to 20,000 kPa pressure range) in order to convert its quality from technical grade white oil to pharmaceutical grade quality. White oils produced by the method described are highly naphthenic. However, highly naphthenic white oils can be made by other methods, as will be known by those skilled in the art. In the present invention, both technical and pharmaceutical grades of white oil may be employed. The pharmaceutical grade is more expensive, but has the benefit that, when blended with polyisoalkylene and optionally other additives, the resulting automotive lubricating composition has greater oxidation stability than a similar blend based on technical white oil. The oxidation stability of white oils and oil compositions containing white oils is generally poor. It is therefore considerably surprising that compositions of polyisoalkylene compounds and either white oils or oil compositions containing white oils have such outstandingly good oxidation stability.

The naphthenic composition of preferred highly naphthenic white oils advantageously used in the present invention is preferably as follows, the measurements being obtained using standard test method ASTM D 2786:

1 ring: 20–30 wt. %, preferably 24–32 wt. %

2 rings: 13–27 wt. %, preferably 17–23 wt. %

3 rings: 4–21-wt. %, preferably 8–17 wt. %

4 rings: 3–19 wt. %, preferably 7–15 wt. %

5 rings or more: 0–9 wt. %, preferably 2–5 wt. %

Commercially-available examples of suitable FDA regulation food grade quality white oils that can be used in the present invention include MARCOL 52—naphthenic content 34%, MARCOL 82—naphthenic content 32%, MARCOL 172—naphthenic content 34%, PRIMOL 352—naphthenic content 32%, and PLASTOL 352—naphthenic content 32%, all supplied by Exxon/Esso. Examples of suitable FDA regulation technical grade white oils that can be used in the present invention include BAYOL 52—naphthenic content 34% and PLASTOL 135—naphthenic content 36%, both supplied by Exxon/Esso. MARCOL, PRIMOL, PLASTOL and BAYOL are trade marks of Exxon Corporation. The naphthenic content is measured according to standard test method ASTM 2140.

The basestock may comprise 100% white oil, or it may comprise a blend or composition of white oil with one or more other types of oil, for example conventional mineral oil, a synthetic oil such as a polyalphaolefin or an ester such as a polyol ester or diester, a hydrocracked basestock, a hydroisomerised basestock, or a mixture of two or more thereof. If the basestock is a blend, the preferred proportion of white oil in the basestock is at least 30 wt. %, more preferably between 30 and 60 wt. %.

The polyisoalkylene is preferably a low molecular weight polymer in the range from 400 to 30,000, preferably 500 to 30,000, and more preferably 800 to 10,000. A low molecular weight polymer is beneficial because it tends not to shear under stress and retains its viscosity in use.

Preferably the alkylene group of the polyisoalkylene contains from 3 to 10 carbon atoms, more preferably from 3 to 6. Most preferred is polyisobutylene.

The polyisobutylene is combined with one or more other antioxidant additives in the lubricant composition. This other-antioxidant may be selected from conventional lubricant antioxidant additives, such as for example, atomic antioxidants, e.g. diphenylamines; hindered phenols; sulphurised phenols; phospho-sulphurised alkylphenols; dithiophosphates, e.g. zinc dialkyl dithiophosphate, zinc diaryl dithiophosphate, zinc alkylaryl dithiophosphate and ashless thiophosphate compounds, dimercapto dithiodiazole; alkyl phenol sulphides; alkyl thiocarbamates such as zinc alkyl dithiocarbamates; and copper-based antioxidants. Preferably this other antioxidant is aminic.

The amount of polyisoalkylene included in the lubricant composition is from 5 to 50 wt. % based on the total weight of the lubricant composition, preferably from 5 to 20 wt. %, more preferably from 5 to 15 wt. %.

Where another antioxidant is included, this is typically in an amount from 0.1 to 5 wt. % based on the total weight of the lubricant composition, preferably 0.5 to 2 wt. %.

The viscosity index (VI) of the oils was determined according to ASTM D-2270 from the KV40 and KV100 measurements taken at the start of the oxidative stability test. Example IA had a VI of 105 and Example IB had a VI of 109.

EXAMPLE 2

Two white off-based gear oils were formulated as follows

| Component | Example 2A - Invention (wt. %) | Example 2B - Comparative (wt. %) |
|---|---|---|
| MARCOL 82[1] | 80.55 | 89.55 |
| PIB[2] | 9.00 | — |
| IRGANOX L-57[3] | 0.95 | 0.95 |
| Addpack[4] | 8.50 | 8.50 |
| Pour point depressant | 1.00 | 1.00 |

[1]White oil basestock available from Esso S.A.F., France.
[2]Polyisobutylene having a molecular weight of 950.
[3]An aminic antioxidant available from Ciba-Geigy.
[4]A standard gear oil additive package.
[5]A polymethacrylate pour point depressant..

Again, the two formulations were identical in every respect except that Example 2A contained 9.00wt. % polyisobutylene and a correspondingly smaller amount of basestock. The formulations were tested for oxidative stability as described in Example 1, and the results are given in Table 1 below.

Example 2A had a VI (ASTM D-2270) of 126 and Example 2B a VI of 118.

TABLE 1

| | KV 40 ($mm^2/s$) | | | |
|---|---|---|---|---|
| Time (hours) | Example 1A | Example 1B | Example 2A | Example 2B |
| 0 | 96.83 | 68.87 | 26.06 | 17.71 |
| 96 | 150.4 | 151.4 | 39.61 | 49.30 |
| 144 | 163.4 | 174.4 | 43.69 | 64.56 |
| 192 | 175.3 | 160.9 | 50.30 | 64.84 |
| KV increase (%) | 81.0 | 133.6 | 93.0 | 266.1 |

TABLE 2

| | KV 100 ($mm^2/s$) | | | |
|---|---|---|---|---|
| Time (hours) | Example 1A | Example 1B | Example 2A | Example 2B |
| 0 | 11.44 | 9.18 | 5.10 | 3.93 |
| 96 | 16.05 | 18.93 | 6.94 | 10.35 |
| 144 | 17.32 | 19.70 | 7.68 | 12.12 |
| 192 | 18.42 | 18.80 | 8.51 | 11.98 |
| KV increase (%) | 61.0 | 104.8 | 66.0 | 204.8 |

Examples 1A and 2A referring to white oil compositions containing polyisobutylene demonstrate significantly smaller increases in KV 40 and KV 100, thus showing that oil formulations according to the invention exhibit greatly superior stability.

The results in Tables 1 and 2 show that white oil lubricant formulations have superior stability when they contain polyisobutylene.

EXAMPLE 3

Five gear oils having a white off basestock were formulated as follows, using the same components as in the previous examples. All proportions are in weight percent.

The VI (ASTM D-2270) of each oil is given at the bottom of the table.

| Component | Example 3A (comparative) | Example 3B (invention) | Example 3C (invention) | Example 3D (invention) | Example E (invention) |
|---|---|---|---|---|---|
| MARCOL 82 | 89.5 | 86.5 | 80.5 | 69.5 | 39.5 |
| PIB | — | 3.0 | 9.0 | 20.0 | 50.0 |
| IRGANOX L-57 | 1.0 | 1.0 | 0.95 | 1.0 | 1.0 |
| Addpack | 8.5 | 8.5 | 8.5 | 8.5 | 8.5 |
| Pour point depressant | 1.0 | 1.0 | 1.0 | 1.0 | 1.0 |
| VI | 114 | 117 | 126 | 125 | 102 |

The five gear oils were subjected to the standard oxidative stability test GFC T 021 A 90 at 160° C. up to 192 hours. The test results are given in Tables 3 and 4.

The results in Tables 3 and 4 suggest that the improvement in oxidative stablity conferred by the presence of polyisobutylene in the specific formulations of Example 3 is generally greater when the concentration of polyisoalkylene exceeds 3 wt. %. At concentrations above 20 wt. %, the oxidative stability is significant, but tends to reduce at a concentration of 50 wt. %. The optimum concentration range seems to be in the range from above 3 to below 20 wt. %, especially about 9 wt. %.

TABLE 3

| | KV 40 ($mm^2/s$) | | | | |
|---|---|---|---|---|---|
| Time (hours) | Example 3A | Example 3B | Example 3C | Example 3D | Example 3E |
| 0 | 15.99 | 18.00 | 26.06 | 39.43 | 227.2 |
| 192 | 84.0 | 111.0 | 50.3 | 10.2 | 95.2 |
| KV 40 Increase % | 425 | 517 | 93 | 159 | 319 |

TABLE 4

| | KV 100 ($mm^2/s$) | | | | |
|---|---|---|---|---|---|
| Time (hours) | Example 3A | Example 3B | Example 3C | Example 3D | Example 3E |
| 0 | 3.66 | 3.96 | 5.10 | 6.69 | 20.15 |
| 192 | 13.0 | 16.6 | 8.51 | 13.5 | 56.4 |
| KV 100 Increase % | 257 | 320 | 66.0 | 101 | 180 |

We claim:

1. An automotive lubricant oil composition or automotive fluid composition for use in an automotive engine or automotive gearbox or automotive automatic transmission, said composition consisting essentially of the following components:

(a) a basestock comprising at least 30 wt. % of white oil;

(b) as an anti-oxidant, from 5 to 50 wt. % of polyisoalkylene having a molecular weight in the range of from 400 to 30,000;

(c) from 0.1 to 5 wt % of another engine oil, gear oil or automotive transmission anti-oxidant selected from aminic anti-oxidants, hindered phenols, sulphurised phenols, phosphosulphurised alkyl phenols, dithiophosphates, dimercaptodithiadiazoles, alkyl phenol sulphides, alkyl thiocarbamates and copper-based anti-oxidants; and (d) one or more additional engine oil, gear oil or automotive transmission fluid additives selected from the group consisting of detergents, dispersants, anti-wear agents, extreme-pressure agents, anti-corrosion agents, pour point depressants, anti-foam agents, friction modifiers, anti-squawk agents and viscosity improvers, the automotive oil composition or automotive fluid composition having a and viscosity in the range of from 4 to 50 $mm^2/s$ at 100° C. and a viscosity index in the range of from 80 to 200.

2. A lubricant composition according to claim 1 wherein the alkylene group in the polyisoalkylene contains from 3 to 10 carbon atoms.

3. A lubricant composition according to claim 2 wherein the polyisoalkylene is polyisobutylene.

4. A lubricant composition according to any one of claims 1 to 3 wherein the amount of basestock is in the range of from 50 to 95 weight percent and the amount of polyisoalkylene is in the range of 5 to 20 weight percent based on the total weight of the lubricant composition.

5. A lubricant composition according to claim 1, 2 or 3 having one of the following ranges of properties:

(i) automotive engine oil composition: viscosity in the range of from 4 to 35 $mm^2/s$ at 100° C. and a viscosity index in the range of from 85 to 160;

(ii) automotive gear oil: viscosity in the range of from 5 to 50 $mm^2/s$ at 100° C. and a viscosity index in the range of from 80 to 180;

(iii) automotive automatic transmission fluid: viscosity in the range of from 4 to 10 $mm^2/s$ at 100° C. and a viscosity index in the range of from 100 to 200.

6. A method of operating automotive equipment selected from one or more of an internal combustion engine, a gearbox and an automatic transmission, the method comprising lubricating the said equipment with an automotive lubricating oil composition according to claim 1, 2, or 3.

7. A method of providing or enhancing protection against oxidation of an automotive fluid composition or an automotive lubricating oil comprising a white-oil-based base stock having a viscosity in the range of from 4 to 50 $mm^2/s$ at 100° C. and a viscosity index in the range of from 80 to 200, the method comprising adding to or incorporating with the lubricating oil or fluid composition from 5 to 50 weight % of a polyisoalkylene compound having a molecular weight in the range of from 400 to 30,000.

8. A method of lubricating an automotive engine, or automotive gearbox or automotive automatic transmission for an extended period by employing as the lubricant a lubricating oil composition comprising:

(a) a basestock comprising at least 30 wt. % of white oil;

(b) as an anti-oxidant, from 5 to 50 wt. % of polyisoalkylene having a molecular weight in the range of from 400 to 30,000;

(c) from 0.1 to 5 wt. % of another automotive anti-oxidant selected from aminic anti-oxidant, hindered phenols, sulphurised phenols, phosphosulphurised alkyl phenols, dithiophosphates, dimercapto-dithiadiazoles, alkyl phenol sulphides, alkyl thiocarbamates and copper-based anti-oxidants; and (d) one or more additional automotive additives selected from detergents, dispersants, anti-wear agents, extreme-pressure agents, anti-corrosion agents, pour point depressants, anti-foam agents, friction modifiers, anti-squawk agents, viscosity improvers other than the said polyisoalkylene of component (b).

9. The method according to claim 8 wherein the alkylene group in the polyisoalkylene contains from 3 to 10 carbon atoms.

10. The method according to claim 8 wherein the polyisoalkylene is polyisobutylene.

11. The method according to claim 8, 9 or 10 wherein the amount of basestock is in the range of from 50 to 95 weight percent and the amount of polyisoalkylene is in the range of from 5 to 20 weight percent based on the total weight of the lubricant compositions.

* * * * *